United States Patent [19]

Gibas

[11] Patent Number: 4,521,759

[45] Date of Patent: Jun. 4, 1985

[54] ACTIVATING MAGNET

[75] Inventor: Cristoph Gibas, Neunkirchen, Fed. Rep. of Germany

[73] Assignee: bso Steuerungstechnik GmbH, Fed. Rep. of Germany

[21] Appl. No.: 601,299

[22] Filed: Apr. 17, 1984

[30] Foreign Application Priority Data

May 11, 1983 [DE] Fed. Rep. of Germany ..... 3317226

[51] Int. Cl.[3] ..... H01F 7/08

[52] U.S. Cl. ..... 335/255; 335/274; 251/138; 251/141

[58] Field of Search ..... 335/255, 257, 258, 273, 335/274, 277; 251/138, 141

[56] References Cited

U.S. PATENT DOCUMENTS 1,603,005 10/1926 Flam ..... 251/138 X 2,955,240 10/1960 Gardner ..... 335/273

3,805,203 4/1974 Deckard ..... 335/258 X 4,399,421 8/1983 MacLean ..... 335/273 X

*Primary Examiner*—George Harris

*Attorney, Agent, or Firm*—Wigman & Cohen

[57] ABSTRACT

An activating magnet has a magnet housing (1), a pole element (10) arranged at one end of the magnet housing, a magnetic coil (13) surrounding the magnet housing and the pole element, and a magnet armature (3) movably housed in a magnet housing. An activating spring (20), biased between said magnet armature (3) and the pole element, and an activating member (5) are arranged on the side of the magnet armature opposite the pole element. In order to arrange an emergency manual activation on the magnet, a hand bolt (18), particularly a manually activated hand bolt, is provided on the side opposite the activating member. The hand bolt (18) is connected with the magnet armature to make it possible to exert a tensile force on the magnet armature.

8 Claims, 1 Drawing Figure

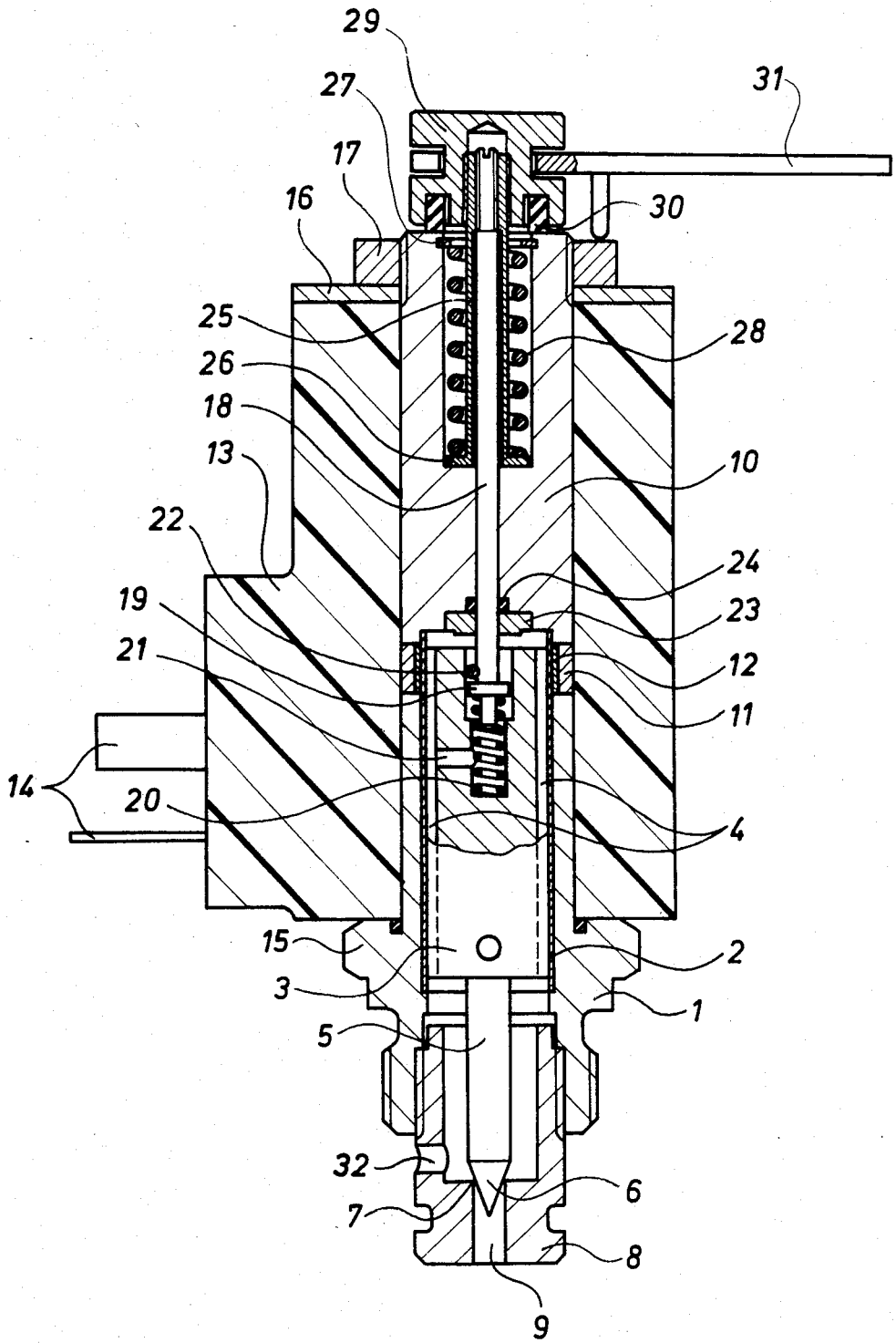
29
27
31
17
16
30
25
28
26
18
13
10
22
24
19
23
21
12
11
14
20
4
15
2
3
1
5
32
6
7
8
9

ACTIVATING MAGNET

BACKGROUND OF THE INVENTION

The invention relates to an activating magnet which exerts a pulling force on its associated activating member when its coil is excited. In such a magnet, an emergency hand activation should be provided.

SUMMARY AND OBJECTS OF THE INVENTION

The distinguishing characteristics are directed in a novel manner to the special design of such an emergency manual activation. With the aid of a hand bolt, the armature can be removed out of its rest position against the force of its activating spring.

An object of the invention is to simplify the emergency manual activation, whereby the force exerted on the hand bolt by the pressure of a hydraulic medium, and if necessary the force exerted by the activating spring, can be compensated for.

Another object of the invention is to provide a simple adjustment of the pressure compensation.

Yet another object is to make possible a movement of the magnet armature relative to the hand bolt to prevent the activating spring within the magnet armature from becoming ineffective.

Still another object is directed to a space-saving short construction of the activating magnet.

Another object is to significantly reduce the danger of an unintentional or intentional activation of a seat valve.

Yet another object is to make it difficult for dirt to penetrate into the activating magnet, at least in the rest position of its elements.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

In the drawing is shown a cross-sectional view of an activating magnet for a seat valve as an exemplary embodiment of the invention.

DETAILED DESCRIPTION OF A PREFERRED EMBODIMENT

Referring now in detail to the drawing, there is illustrated an essentially cylindrical magnet armature 3 mounted so as to be axially slidable in a magnet housing 1 within a guide bushing 2 consisting of a non-magnetizable material. The magnet armature 3 has grooves 4 running along its outer side.

An activating member 5 is provided on the bottom side of the magnet armature 3 as viewed in the drawing, said activating member 5 having a conical tip formed as a valve member 6 which cooperates with a valve seat 7 provided in the floor of a sleeve-like valve housing 8 on the inner end of a discharge bore 9. A supply bore 32, which is subject to the pressure of a hydraulic medium during operation, is located in the wall of the valve housing 8. The valve housing is threaded into the magnet housing 1, which itself can be threaded into another element, not shown.

A pole element 10 is arranged on the end of the magnet housing 1 opposite the valve housing 8. It is connected therewith by means of a connecting ring 11 made of brazing solder, which surrounds a spacing ring 12 which covers the guide bushing 2 and is made of a non-magnetizable material. The ends of the magnet housing 1 and the pole element 10 facing each other are surrounded by a magnetic coil 13 which is coiled onto a magnetic spool and embedded in a plastic, and includes outwardly projecting connecting lugs 14. The magnet housing 1 has a collar 15 formed as a polygon on its underside, as shown in the drawing. The gap between the collar 15 and the magnetic coil 13 is sealed by a sealing ring. The pole element 10 projects at its upper side, as shown in the drawing, beyond the magnetic coil 3 and an end plate 16 located thereon. A lock nut 17 is threaded onto the projecting end of the pole element 10.

The pole element 10 is penetrated by a hand bolt 18, which projects into a concentrically arranged blind bore in the magnet armature 3 and has a collar 19 arranged within the magnet armature 3 and spaced from its end. An activating spring 20 is biased between the collar 19 and the base of the blind bore in the magnet armature 3. The chamber containing the activating spring 20 is connected with one of the longitudinal grooves 4 by means of a lateral bore 21. A lateral pin 22 inserted in the magnet armature 15 prevents the collar 19 from leaving the magnet armature 3.

An impact plate 23 is provided on the side of the pole element 10 facing the magnet armature 3. The gap between the pole element 10 and the hand bolt 18 is sealed on the side of the impact plate 23 opposite the magnet armature 3 by a sealing ring 24. A positioning bushing 25 which also projects beyond the pole element 10 on the upper side as shown in the drawing. A support flange 26 is provided on the end of this positioning bushing 25 arranged in a blind bore in the pole element 10. A compensating spring 28 is biased between this support flange 26 and a lock washer 27 inserted into the pole element 10 at the extreme end of its blind bore. An activating element 29 is threaded onto the end of the positioning bushing 25 projecting out of the pole element 10. A fork key 31 supported on the lock nut 17 can be inserted into the annular groove in the activating element 29 to move the hand bolt 18 in the direction of its axis. In this manner the activating element 29 cannot be easily activated and the sealing valve 6, 7 opened, in order to avoid an unintentional or dangerous opening of this seating valve. A tubular annular seal 30 is arranged between the activating member 29 and the pole element 10, so that in the position of the activating element 29 shown in the drawing, no dirt or moisture can penetrate between the activating element 29 and the pole element 10.

In the position illustrated in the drawing, the valve 6, 7 is closed. The pressure prevailing in the supply bore 32 also prevails on both sides of the magnet armature 3. The valve member 6 is held against its seat with the force of the activating spring 20 biased between the magnet armature 3 and the hand bolt 18. In addition, the pressure due to the difference in diameter of the magnet armature 3 and the hand bolt 18 acts in the direction of closing, and the pressure due to the difference in diameter of the magnet armature 3 and the valve seat 7 acts in the direction of the opening. Depending on whether the diameter of the valve seat 7 or the hand bolt 18 is larger, the hydraulic medium pressure will act either in the opening or in the closing direction. In the abovedescribed exemplary embodiment the diameter of the valve seat 7 is larger than the diameter of the hand bolt 18, so that a force is exerted by the hydraulic medium pressure in the closing direction of the seating valve 6, 7. The compensating spring 28 is prebiased in such a manner that its force is somewhat larger than the force of the activating spring 20 plus the product of the hydraulic medium pressure due to the difference of the diameter of the valve seat 7 and the hand bolt 18. The collar 19 is held at a distance from the lateral pin 22, as shown in the drawing. This lateral pin 22 and the collar 19 located on the inner end of the hand bolt 18 form a type of drag connection which does not become effective until the hand bolt 18 has traveled through a certain distance during removal, particularly by hand, for which purpose it is moved upward for emergency manual activation, as viewed in the drawing. By means of this movement it is possible to open the valve 6, 7 and release the pressure in the supply bore 32. When no further force is exerted on the hand bolt 18 directed away from the valve 6, 7, then this valve closes and the elements of the activating magnet reassume their position illustrated in the drawing.

When the magnetic coil 13 is subjected to voltage, i.e. when the magnet system is excited, the magnet armature 13 is moved in the direction toward the compensating spring 28, and as a result the seating valve 6, 7 is opened against the force of the activating spring 20 which is biased to hold the seat valve 6, 7 closed.

What I claim is:

1. An activating magnet comprising:

a magnet housing, a magnet armature movably housed in the magnet housing, and a pole element a magnetic coil surrounding the magnet housing;

an activating spring biased between the magnet armature and the pole element;

an activating member arranged on the side of the magnet armature opposite the pole element; and a hand bolt slidably arranged within said magnet housing and connected to the opposite side of the armature as the activating member such that the hand bolt may exert a tensile force on the armature and may also be used to slidably release that tensile force from said armature.

2. The activating magnet according to claim 1, further comprising a compensating spring biased between the hand bolt and the pole element, said compensating spring is biased so as to urge the hand bolt toward the activating member arranged on the magnet armature.

3. The activating magnet according to claim 2, wherein the biasing tension in the compensating spring is adjustable.

4. The activating magnet according to claim 1, wherein the hand bolt is connected with the magnet armature with axial play in the manner of a drag connection.

5. The activating magnet according to claim 1, wherein the activating spring is biased between the hand bolt and the magnet armature and attempts to keep a seating valve closed.

6. The activating member according to claim 2, further comprising a positioning bushing which is adjustable opposite the hand bolt and has a support flange to support the compensating spring, wherein the compensating spring is arranged on the positioning bushing.

7. The activating magnet according to claim 1, further comprising an activating element which includes an engagement point for a tool and is connected to the hand bolt.

8. The activating magnet according to claim 7, further comprising a seal, arranged between the activating element and the pole element, which is effective in the rest position of the activating element.

* * * * *